US010129655B2

(12) United States Patent
Zhu et al.

(10) Patent No.: US 10,129,655 B2
(45) Date of Patent: Nov. 13, 2018

(54) VIBRATION SOUND-PRODUCING APPARATUS

(71) Applicant: GOERTEK INC, Weifang (CN)

(72) Inventors: Yueguang Zhu, Weifang (CN); Hongchao Sun, Weifang (CN); Hua Shi, Weifang (CN)

(73) Assignee: GOERTEK INC, Weifang (CN)

( * ) Notice: Subject to any disclaimer, the term of this patent is extended or adjusted under 35 U.S.C. 154(b) by 0 days.

(21) Appl. No.: 15/579,219

(22) PCT Filed: Nov. 16, 2015

(86) PCT No.: PCT/CN2015/094679
§ 371 (c)(1),
(2) Date: Dec. 4, 2017

(87) PCT Pub. No.: WO2016/192316
PCT Pub. Date: Dec. 8, 2016

(65) Prior Publication Data

US 2018/0184209 A1 Jun. 28, 2018

(30) Foreign Application Priority Data

Jun. 5, 2015 (CN) ..... 2015 1 0304183

(51) Int. Cl.
*H04R 9/00* (2006.01)
*H04R 9/06* (2006.01)
(Continued)

(52) U.S. Cl.
CPC ..... *H04R 9/06* (2013.01); *H04R 9/02* (2013.01); *H04R 9/025* (2013.01); *H04R 31/00* (2013.01);
(Continued)

(58) Field of Classification Search
CPC ..... H04R 9/06; H04R 1/025; H04R 9/025; H04R 3/00; H04R 2499/11
(Continued)

(56) References Cited

U.S. PATENT DOCUMENTS

2013/0051603 A1* 2/2013 Takewa ..... H04R 9/04 381/398
2015/0117699 A1* 4/2015 Cai ..... H01F 7/0289 381/412
2016/0119718 A1* 4/2016 Yang ..... H04R 9/02 381/351

FOREIGN PATENT DOCUMENTS

CN 201629840 11/2010
CN 102256195 11/2011
(Continued)

*Primary Examiner* — Disler Paul
(74) *Attorney, Agent, or Firm* — JMB Davis Ben-David

(57) ABSTRACT

Disclosed is a vibration sound-producing apparatus. A sound output aperture of the vibration sound-producing apparatus is provided at a lateral surface. A diaphragm corresponds to the position of the sound output aperture. A flat sound coil is perpendicular to the diaphragm. A magnet is parallel to the sound coil. The vibrating direction of the sound coil avoids a thickness direction. The vibrating direction of the magnet and a mass block also avoids the thickness direction. The mass block is fixedly joined to a housing via a flexible piece. This facilitates reduced product thickness, increased product performance, and a simplified product production process. Therefore, the vibration sound-producing apparatus of the present invention has the advantages of a great thickness-reduced design, great performance, and simple assembly.

9 Claims, 3 Drawing Sheets

(51) Int. Cl.
*H04R 9/02* (2006.01)
*H04R 31/00* (2006.01)

(52) U.S. Cl.
CPC ..... *H04R 2400/03* (2013.01); *H04R 2499/11* (2013.01)

(58) Field of Classification Search
USPC ..... 381/334
See application file for complete search history.

(56) References Cited

FOREIGN PATENT DOCUMENTS

| | | | |
|---|---|---|---|
| CN | 104469633 | | 3/2015 |
| CN | 104883649 | | 9/2015 |
| CN | 204697286 | | 10/2015 |
| CN | 105101022 | A1 * | 11/2015 |

* cited by examiner

VIBRATION SOUND-PRODUCING APPARATUS

CROSS-REFERENCE TO RELATED APPLICATIONS

This is the U.S. National Stage of International Application No. PCT/CN2015/094679 filed Nov. 16, 2015, which was published in Chinese under PCT Article 21(2), and which in turn claims the benefit of CN Patent Application No. 201510304183.0 filed Jun. 5, 2015.

TECHNICAL FIELD

The present invention relates to the technical field of electroacoustics, and more particularly, to a vibration sound-producing apparatus.

BACKGROUND ART

A vibration speaker is a multi-functional acoustic device, which may not only achieve the vibration sound-producing functionality as an ordinary speaker, but also achieve the functionality of a vibrating motor. The vibration speaker may save the internal space of a portable electronic terminal, simplify the assembly process of the portable electronic terminal, and reduce the cost of the portable electronic terminal. Therefore, the vibration speaker has been increasingly and widely used in the field of portable electronic terminal.

The existing vibration sound-producing apparatus with a conventional structure comprises a vibration system and magnetic circuit system. The vibration system comprises a vibrating diaphragm, and a cylindrical voice coil which is integrated with the vibrating diaphragm. The magnetic circuit system comprises a magnet, and a magnetic gap in which the cylindrical voice coil is provided. When the vibration speaker is in operation, the cylindrical voice coil drives the vibrating diaphragm to vibrate in the vertical direction to produce sound under lorentz force, while the magnetic circuit system is subjected to reaction force and resonates in the vertical direction. The vibration speaker with such a structure is limited in the volume of the cylindrical voice coil and the space for vibration of the cylindrical voice coil, and a mass block combined with the magnetic circuit system is further required to be provided in the vertical direction, which thickens the thickness in the vertical direction and cannot meet the requirement on thin-type of the product. With the improvements on thin-type and miniaturization design of the portable electronic terminal, the existing vibration sound-producing apparatus cannot meet the development trend of thin-type and miniaturization. Moreover, the existing vibration sound-producing apparatus with a conventional structure has complex internal components, and thus high difficulty in assembly has always been a difficult problem in the industry.

Therefore, it is necessary to provide an improvement to overcome the drawbacks of the vibration sound-producing apparatus in the prior art.

SUMMARY

The technical problem sought to be solved by the present invention is to provide a vibration sound-producing apparatus having improved thin-type design, good performance and simple assembly.

In order to achieve the above objective, the vibration sound-producing apparatus of the present invention employs the following technical solution:

a vibration sound-producing apparatus, comprising a housing, and a vibration system and a magnetic circuit system accommodated in the housing, wherein the housing comprises an upper end surface, a lower end surface and a lateral surface connecting the upper end surface and the lower end surface, and the lateral surface of the housing is provided with a sound hole for emitting sound; the vibration system comprises a vibrating diaphragm, a voice coil and a transmission structure, the vibrating diaphragm is provided at a position corresponding to the sound hole, and a plane in which the vibrating diaphragm is located is parallel to the lateral surface in which the sound hole is located; the voice coil has a flat structure, and a plane in which the voice coil is located is perpendicular to the plane in which the vibrating diaphragm is located; the vibrating diaphragm and the voice coil are connected with each other through the transmission structure; the magnetic circuit system comprises a magnet which is parallel to the voice coil; the vibration sound-producing apparatus further comprises a mass block and an elastic piece, the magnet is fixedly combined with the mass block, and the mass block is suspended in the housing via the elastic piece; the elastic piece comprises a first fixing part, a second fixing part and a connecting part; the first fixing part is fixedly combined with the housing, the second fixing part is fixedly combined with the mass block, and the first fixing part and the second fixing part are connected with each other through the connecting part.

As a preferred technical solution, the connecting part has an elastic structure, and the mass block and the magnet which are suspended in the housing vibrate in accord with an elastic direction of the elastic structure.

As a preferred technical solution, the elastic piece has a strip shape, and two ends of the elastic piece having the strip shape are provided with two first fixing parts, and distances from the second fixing part to the two first fixing parts are equal; the first fixing parts and the second fixing part are provided on two parallel planes; the connecting part having the elastic structure consists of two parts which connect the second fixing part with the two first fixing parts respectively.

As a preferred technical solution, the vibration sound-producing apparatus comprises two elastic pieces mentioned-above, and the two elastic pieces are provided at two ends of the mass block respectively; and the two elastic pieces are symmetrically arranged with respect to the mass block.

As another preferred technical solution, the housing is provided with a connecting piece at a position corresponding to the elastic piece, and the first fixing part is fixedly combined with the connecting piece. As a further preferred technical solution, the connecting piece is integral with the housing through injection molding.

As another preferred technical solution, the magnetic circuit system is provided at one side of the voice coil; the mass block is provided with a positioning groove at a position corresponding to the fixing position of the magnet, and the magnet is provided in the positioning groove. As a further preferred technical solution, the positioning groove passes through the mass block, and a magnetic conductive plate is provided at a side of the mass block away from the voice coil, and a side of the magnet away from the voice coil is fixed to the magnetic conductive plate. As another further preferred technical solution, the magnetic circuit system comprises two magnets mentioned-above, and the mass block is provided with positioning grooves at positions corresponding to the two magnets. As a still further preferred technical solution, the voice coil having the flat structure has a racetrack shape, and two straight sides of the voice coil having the racetrack shape correspond to the two magnets; and polarization directions of the two magnets are opposite to each other.

In the vibration sound-producing apparatus of the present invention, the sound hole is provided in the lateral surface of the housing of the sound-producing apparatus, which avoids the requirement on thickness of the external portable electronic terminal in the vertical direction due to a front sound hole, and avoids blocking of the sound hole due to insufficient thickness in the vertical direction of the electronic terminal, thereby ensuring the sound effect of the vibration sound-producing apparatus; the vibrating diaphragm of the vibration system corresponds to the sound hole, that is, the plane of the vibrating diaphragm is parallel to the lateral surface in which the sound hole is located, the voice coil has a flat structure, and the plane of the voice coil is perpendicular to the plane of the vibrating diaphragm, which effectively decreases the occupancy of the voice coil in the thickness of the vibration sound-producing apparatus, and changes the vibration direction of the voice coil during operation of the vibration sound-producing apparatus, so that the voice coil vibrates in the horizontal direction and drives the vibrating diaphragm to vibrate and generate sound through the transmission structure; the plane in which the magnet is located is parallel to the plane of the voice coil, the magnet is fixed to the mass block and is suspended inside the housing, and the magnet is subjected to the reaction force by the voice coil when the voice coil is energized, so that the integral structure of the magnet and the mass block resonates at a certain frequency and vibrates back and forth in the plane in which the magnet is located, and thus the vibration sound-producing apparatus achieves vibration function. In the vibration sound-producing apparatus according to the present invention, as the voice coil has a flat structure, the size limit of the external portable electronic terminal on the vibration sound-producing apparatus in the vibrating direction of the voice coil is small, the vibrating direction of the voice coil avoids the thickness direction, and the vibrating direction of the integral structure of the magnet and the mass block also avoids the thickness direction, which facilitates the thin-type design of the product, meanwhile, the space for vibration may be increased, and the product performance may be improved; in addition, the mass block is fixed to the housing through the elastic piece, and the elastic piece is easy to assemble and has lower difficulty in process. Therefore, the vibration sound-producing apparatus of the present invention has the advantages of improved thin-type design, great performance, and simple assembly.

DETAILED DESCRIPTION OF EMBODIMENTS

Hereinafter, the contents of the present invention will be described in detail with reference to the accompanying drawings.

Figure 1:
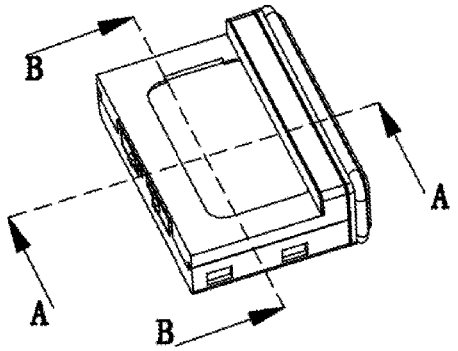
FIG. 1 is a perspective view of a specific embodiment of the vibration sound-producing apparatus of the present invention.
Figure 2:
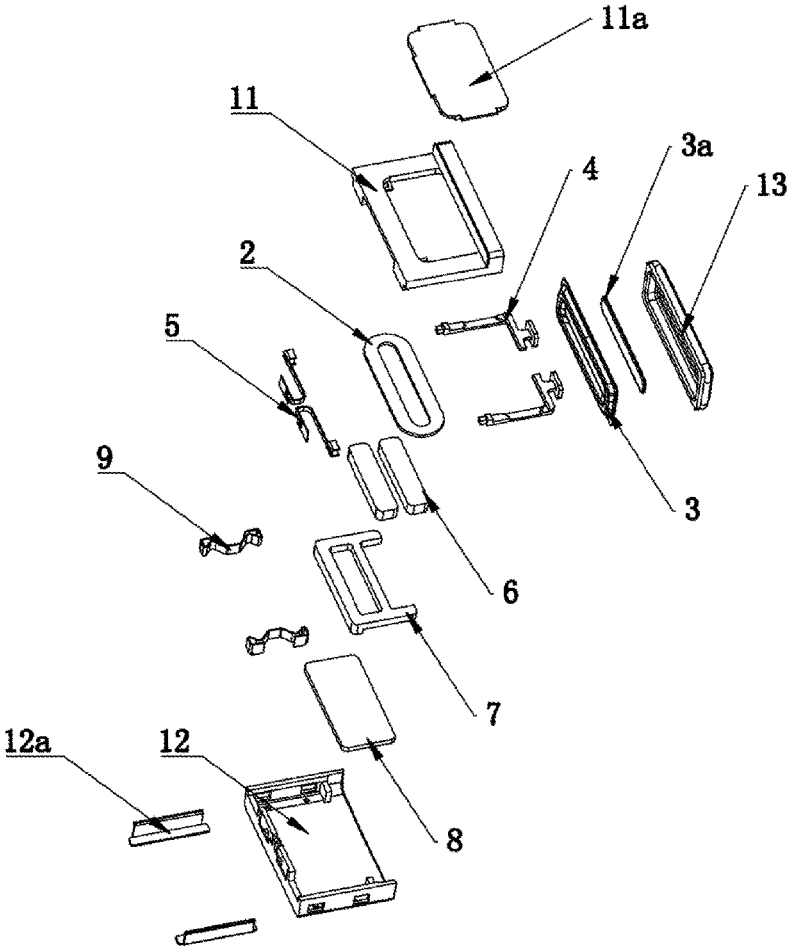
FIG. 2 is an exploded view of the vibration sound-producing apparatus shown in FIG. 1.
Figure 3:
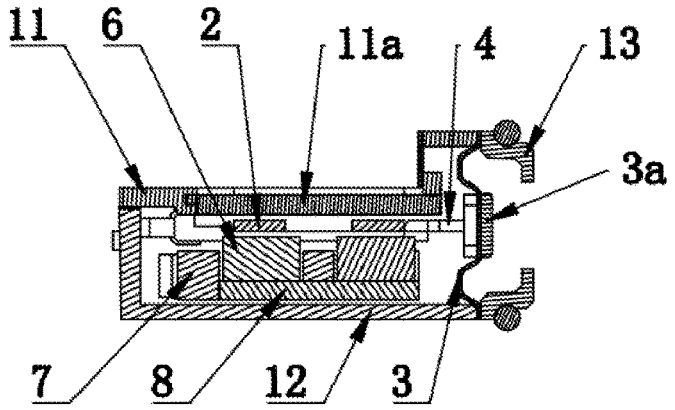
FIG. 3 is a sectional view taken along line A-A of the vibration sound-producing apparatus shown in FIG. 1.
Figure 4:
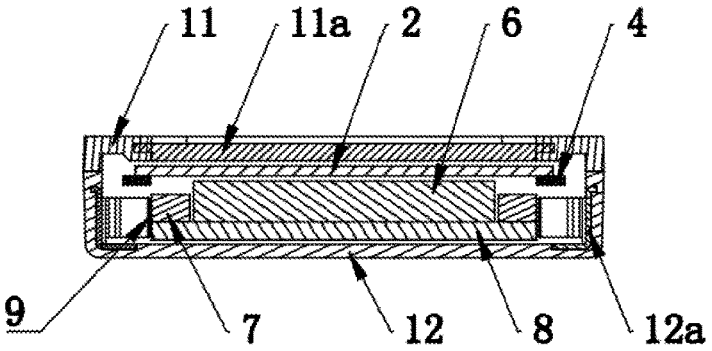
FIG. 4 is a sectional view taken along line B-B of the vibration sound-producing apparatus shown in FIG. 1.
Figure 6:
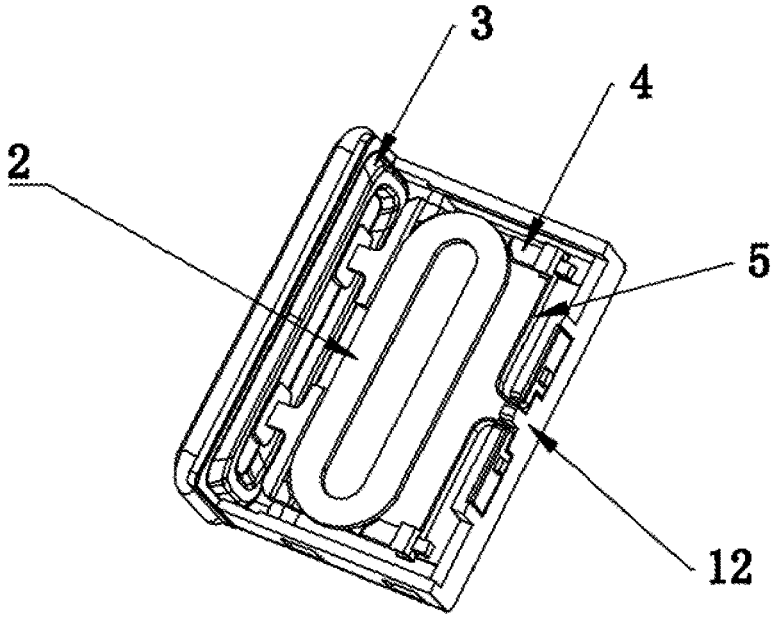
FIG. 6 is a schematic view of the assembly of the vibration system of the vibration sound-producing apparatus shown in FIG. 1.

As shown in FIG. 2, the vibration sound-producing apparatus of the present invention comprises a housing, a vibration system and a magnetic circuit system. The housing comprises a first housing 11, a second housing 12, and a side cover 13 fixed to the side walls of the first housing 11 and the second housing 12. The vibration system and the magnetic circuit system are provided in the cavity defined by the first housing 11, the second housing 12, and the side cover 13. The side cover 13 is provided with a sound hole for emitting sound. As shown in FIGS. 2 and 3, the vibration system comprises a vibrating diaphragm 3, a voice coil 2, and a transmission structure 4. The vibrating diaphragm 3 is provided at a position facing the side cover 13 in which the sound hole is provided, that is, the vibrating diaphragm 3 is provided at a position adjacent to the side cover 13, and the plane in which the vibrating diaphragm 3 is located is parallel to the plane in which the side cover 13 is located. The voice coil 2 has a flat structure, and the plane in which the voice coil 2 is located is perpendicular to the plane in which the vibrating diaphragm 3 is located. In the vibration sound-producing apparatus of the present embodiment, the transmission structure connecting the voice coil 2 and the vibrating diaphragm 3 is a transmission arm 4. As shown in FIG. 6, one end of the transmission arm 4 is fixed to the vibrating diaphragm 3, and the other end of the transmission arm 4 is fixed to the second housing 12 through the elastic piece 5, and the transmission arm 4 transfers the vibration of the voice coil 2 to the vibrating diaphragm 3. In order to improve the rigidity of the portion of the vibrating diaphragm 3 combined with the transmission arm 4 and adjust the acoustic performance of the product, as shown in FIGS. 2 and 3, the vibrating diaphragm 3 is provided with a reinforcing part 3*a*, which is also provided on the central plane portion of the vibrating diaphragm 3. As shown in FIGS. 2, 3 and 4, the magnetic circuit system comprises a magnet 6, the magnet 6 is provided at a position facing the voice coil 2, and the plane in which the magnet 6 is located is parallel to the plane in which the voice coil 2 is located. The vibration sound-producing apparatus of the present invention further comprises a mass block 7, the magnet 6 is fixed to the mass block 7, and the mass block 7 is suspended in the housing through the elastic piece 9. The integral structure of the mass block 7 and the magnet 6 may vibrate back and forth in the housing in the force direction of the magnet. In the vibration sound-producing apparatus of the present invention, when the external drive current flows into the voice coil 2, as the voice coil 2 is provided in the magnetic field of the magnet 6, the current in the voice coil 2 provided in the magnetic field changes, so that the voice coil 2 vibrates in the plane in which the voice coil is located due to Lorentz force, and the voice coil 2 vibrates to drive the transmission arm 4 to vibrate, thereby transmitting the vibration to the vibrating diaphragm 3 and enabling the vibrating diaphragm 3 to vibrate and generate sound. When the voice coil 2 is subjected to a magnetic field force, the magnet 6 is also subjected to a reaction force, and the magnet 6 vibrates. When the frequency of the force applied to the magnet 6 is the same as the resonant frequency of the integral structure of the magnet 6 and the mass block 7, the integral structure of the magnet 6 and the mass block 7 vibrates significantly, and thus the vibration sound-producing apparatus is in a vibrating state. In the vibration sound-producing apparatus according to the present invention, as the voice coil has a flat structure, in the vibrating direction of the voice coil, the size limit of the external portable electronic terminal on the vibration sound-producing apparatus is small, which enables the voice coil to obtain a larger space for vibration and increase the amplitude, thereby improving the performance of the vibration sound-producing apparatus. Meanwhile, when the vibration sound-producing apparatus of the present invention achieves vibration function, the vibration direction of the integral structure of the magnet and the mass block is also in the horizontal direction, which avoids occupancy in the thickness and further decrease the thickness of the product, and the size limit in the vibration direction is small, thereby further improving the performance of vibration function.

Figure 5:
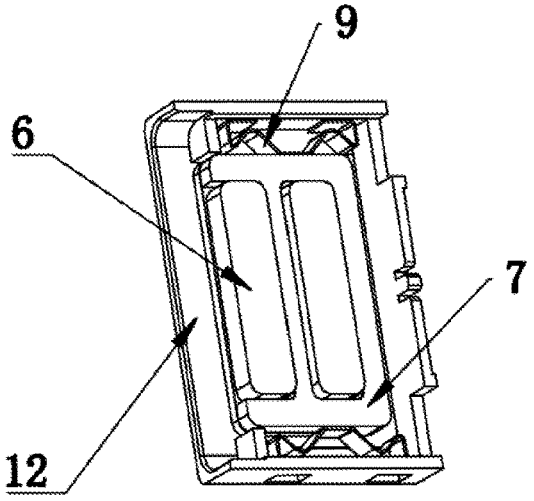
FIG. 5 is a schematic view of the assembly of the magnetic circuit system of the vibration sound-producing apparatus shown in FIG. 1.
Figure 7:
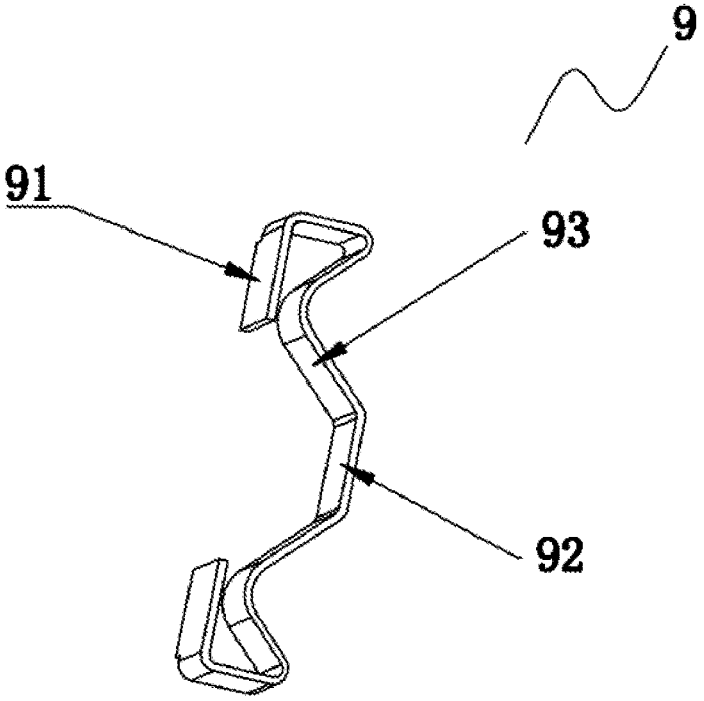
FIG. 7 is a schematic structure view of an elastic piece in a specific embodiment of the vibration sound-producing apparatus of the present invention.

As shown in FIGS. 4 and 5, in the vibration sound-producing apparatus of the present invention, the mass block 7 is fixed to the second housing 12 through the elastic piece 9, and the mass block 7 is suspended in the housing as shown in FIG. 7. The elastic piece 9 comprises a first fixing part 91, a second fixing part 92, and a connecting part 93 for connecting the first fixing part 91 and the second fixing part 92. As shown in FIG. 5, the first fixing part 91 is fixed to the second housing 12, and the second fixing part 92 is fixed to the mass block 7. Due to the design of the elastic piece 9, the mass block 7 may be fixed to the second housing 12 through a simple structure, and the integral structure of the mass block and the magnet may be suspended in the housing, thereby achieving simple assembly, simplifying the design difficulty of positioning between the mass block and the housing, decreasing the difficulty of the process of the vibration sound-producing apparatus of the present invention, and enabling the vibration sound-producing apparatus of the present invention to have the advantages of simple assembly.

As shown in FIG. 7, the connecting part 93 has an elastic structure which may vibrate the fixed structure of the mass block and the magnet in accord with the elastic direction of the connecting part 93 having the elastic structure, thereby improving the resilience force when the integral structure of the mass block and the magnet vibrates, and improving the vibration performance of the vibration sound-producing apparatus. As shown in FIG. 7, the elastic piece 9 of the present embodiment has a strip shape and comprises two first fixing parts 91. The distances from the second fixing part 92 to the two first fixing parts 91 are equal, and the first fixing parts 91 and the second fixing part 92 are located on two parallel planes so that the first fixing part 91 is fixed to the housing, and the second fixing part 92 is fixed to the mass block. The connecting part 93 having the elastic structure consists of two parts which connect the two first fixing parts 91 with the second fixing part 92 respectively. As the distances from the second fixing part 92 to the two first fixing parts 91 are equal, the lengths and the elastic forces of the two parts of the connecting part having the elastic structure are equal, so that the resilience forces in both directions during vibration are equal, which is helpful to improve the vibration performance of the vibration sound-producing apparatus. The two first fixing parts 91 may improve the bonding strength of the elastic piece and the housing, and improve the performance. Meanwhile, the two first fixing parts 91 are combined with the two parts of the connecting part having the elastic structure to ensure that the elastic forces in both directions during vibration of the integral structure of the mass block and the magnet are equal, thereby further improving the vibration performance of the vibration sound-producing apparatus.

As shown in FIGS. 2, 4 and 5, in the vibration sound-producing apparatus of the present embodiment, the number of the elastic pieces 9 is two. Two elastic pieces 9 are provided at two ends of the mass block 7 respectively, and the two elastic pieces 9 are arranged symmetrically with respect to the mass block 7. This structure can effectively suspend the mass block 7 inside the housing while limiting the mass block 7 to prevent polarization during vibration, thereby improving the vibration performance of the vibration sound-producing apparatus.

As shown in FIGS. 2 and 4, in the vibration sound-producing apparatus of the present embodiment, the second housing 12 is provided with connecting pieces 12*a* at positions corresponding to the mounting positions of the elastic pieces 9, and the connecting pieces 12*a* are fixedly combined with the first fixing parts 91 of the elastic pieces 9. The connecting pieces 12*a* may be metal sheets, and may be fixedly combined with the first fixing parts of the elastic pieces 9 by soldering, so as to improve the fixing strength between the housing and the elastic pieces and improve the reliability of the product. In order to decrease the difficulty in production, the connecting pieces 12*a* may be integral with the second housing 12 through injection molding.

As shown in FIGS. 2, 3 and 4, in the vibration sound-producing apparatus of the present embodiment, the mass block 7 is provided with a positioning groove at a position facing the magnet 6, and the magnet 6 is provided in the positioning groove of the mass block 7. In order to increase the volume of the magnet 6, the positioning groove passes through the mass block 7. A magnetic conductive plate 8 is provided at the side of the mass block 7 away from the voice coil, and the magnetic conducting plate 8 fixes the magnet, which facilitates adjustment of the distribution of the magnetic force lines inside the vibration sound-producing apparatus, and improvement of the product performance. As shown in FIGS. 2 and 3, in the vibration sound-producing apparatus of the present embodiment, the number of the magnets 6 is two, and the two magnets 6 are arranged at the two straight sides of the flat racetrack-shaped voice coil 2. The magnetizing directions of the two magnets 6 are opposite to each other so as to ensure that the two straight sides of the voice coil 2 are forced in the same direction. The two magnets 6 improve the magnetic field strength, which facilitates improvement of the product performance.

In practical applications, in order to increase the internal space of the vibration sound-producing apparatus while ensuring the strength of the housing, as shown in FIGS. 2 and 3, the first housing 11 may be provided with a steel sheet 11*a* at a position facing the voice coil and the magnetic circuit system; the steel sheet 11*a* can reduce the thickness and increase the internal space at the position while ensuring the strength at the position, which facilitates increasement in the thickness of the magnetic circuit system and the voice coil and improvement of the product performance. Meanwhile, as a preferred embodiment, under the premise of ensuring product performance, the magnetic circuit system of vibration sound-producing apparatus of the present embodiment is only provided at one side of the voice coil 2, and furthermore, it can be provided at the side away from the steel sheet 11*a* to minimize the thickness of the product to the largest extent and meet the application requirements.

In the vibration sound-producing apparatus of the present invention, the sound hole is provided in the side wall perpendicular to the thickness direction. The vibrating diaphragm is parallel to the plane in which the sound hole is located. The flat voice coil is perpendicular to the vibrating diaphragm. The magnet is parallel to the voice coil. The vibrating direction of the voice coil avoids a thickness direction. The vibrating direction of the integral structure of the magnet and the mass block also avoids the thickness direction, which facilitates the thin-type design of the product, meanwhile, the space for vibration may be increased, and the product performance may be improved. In addition, the mass block is fixed to the housing through the elastic pieces, and elastic pieces are easy to assemble and have lower process difficulty. Therefore, the vibration sound-producing apparatus of the present invention has the advantages of improved thin-type design, great performance, and simple assembly.

The above mentioned are only embodiments of the present invention and are not for limiting the present invention, thus the equivalent modification or variation made by those skilled in the art according to the present invention should be incorporated into the protection scope recorded in the claims.

The invention claimed is:

1. A vibration sound-producing apparatus, comprising: a housing, and a vibration system and a magnetic circuit system accommodated in the housing, wherein the housing comprises an upper end surface, a lower end surface and a lateral surface connecting the upper end surface and the lower end surface, and the lateral surface of the housing is provided with a sound hole for emitting sound;

the vibration system comprises a vibrating diaphragm, a voice coil and a transmission structure, the vibrating diaphragm is provided at a position corresponding to the sound hole, and a plane in which the vibrating diaphragm is located is parallel to the lateral surface in which the sound hole is located; the voice coil has a flat structure, and a plane in which the voice coil is located is perpendicular to the plane in which the vibrating diaphragm is located; and the vibrating diaphragm and the voice coil are connected with each other through the transmission structure, and the transmission structure transfers the vibration of the voice coil to the vibrating diaphragm;

the magnetic circuit system comprises a magnet which is parallel to the voice coil;

the vibration sound-producing apparatus further comprises a mass block and an elastic piece, the magnet is fixedly combined with the mass block, and the mass block is suspended in the housing via the elastic piece; the elastic piece comprises a first fixing part, a second fixing part and a connecting part; and the first fixing part is fixedly combined with the housing, the second fixing part is fixedly combined with the mass block, and the first fixing part and the second fixing part are connected with each other through the connecting part, and the connecting part has an elastic structure, and the mass block and the magnet which are suspended in the housing vibrate in accord with an elastic direction of the elastic structure, and the elastic piece has a strip shape, and two ends of the elastic piece having the strip shape are provided with two first fixing parts, and distances from the second fixing part to the two first fixing parts are equal; the first fixing parts and the second fixing part are provided on two parallel planes; and the connecting part having the elastic structure consists of two parts which connect the second fixing part with the two first fixing parts respectively.

2. The vibration sound-producing apparatus according to claim 1, wherein the vibration sound-producing apparatus comprises two elastic pieces, and the two elastic pieces are provided at two ends of the mass block respectively; and the two elastic pieces are symmetrically arranged with respect to the mass block.

3. The vibration sound-producing apparatus according to claim 1, wherein the housing is provided with a connecting piece at a position corresponding to the elastic piece, and the first fixing part is fixedly combined with the connecting piece.

4. The vibration sound-producing apparatus according to claim 3, wherein the connecting piece is integral with the housing through injection molding.

5. The vibration sound-producing apparatus according to claim 1, wherein the magnetic circuit system is provided at one side of the voice coil; and the mass block is provided with a positioning groove at a position corresponding to a fixing position of the magnet, and the magnet is provided in the positioning groove.

6. The vibration sound-producing apparatus according to claim 5, wherein the positioning groove passes through the mass block, and a magnetic conductive plate is provided at a side of the mass block away from the voice coil, and a side of the magnet away from the voice coil is fixed to the magnetic conductive plate.

7. The vibration sound-producing apparatus according to claim 5, wherein the magnetic circuit system comprises two magnets, and the mass block is provided with positioning grooves at positions corresponding to the two magnets.

8. The vibration sound-producing apparatus according to claim 7, wherein the voice coil having the flat structure has a racetrack shape, and two straight sides of the voice coil having the racetrack shape correspond to the two magnets; and polarization directions of the two magnets are opposite to each other.

9. A vibration sound-producing apparatus, comprising: a housing, and a vibration system and a magnetic circuit system accommodated in the housing, wherein the housing comprises an upper end surface, a lower end surface and a lateral surface connecting the upper end surface and the lower end surface, and the lateral surface of the housing is provided with a sound hole for emitting sound;

the vibration system comprises a vibrating diaphragm, a voice coil and a transmission structure, the vibrating diaphragm is provided at a position corresponding to the sound hole, and a plane in which the vibrating diaphragm is located is parallel to the lateral surface in which the sound hole is located; the voice coil has a flat structure, and a plane in which the voice coil is located is perpendicular to the plane in which the vibrating diaphragm is located; and the vibrating diaphragm and the voice coil are connected with each other through the transmission structure, and the transmission structure transfers the vibration of the voice coil to the vibrating diaphragm;

the magnetic circuit system comprises a magnet which is parallel to the voice coil;

the vibration sound-producing apparatus further comprises a mass block and an elastic piece, the magnet is fixedly combined with the mass block, and the mass block is suspended in the housing via the elastic piece; the elastic piece comprises a first fixing part, a second fixing part and a connecting part; and the first fixing part is fixedly combined with the housing, the second fixing part is fixedly combined with the mass block, and the first fixing part and the second fixing part are connected with each other through the connecting part, and the elastic piece has a strip shape, and two ends of the elastic piece having the strip shape are provided with two first fixing parts, and distances from the second fixing part to the two first fixing parts are equal; the first fixing parts and the second fixing part are provided on two parallel planes; and the connecting part having an elastic structure consists of two parts which connect the second fixing part with the two first fixing parts respectively.

* * * * *